US008883093B2

(12) United States Patent
Koskinen et al.

(10) Patent No.: US 8,883,093 B2
(45) Date of Patent: Nov. 11, 2014

(54) SEALING OF REACTION CUVETTES FOR BIOAFFINITY ASSAYS

(75) Inventors: Janne Koskinen, Turku (FI); Risto-Matti Ruonamo, Turku (FI); Aleksi Soini, Keuruu (FI)

(73) Assignee: ArcDia International Oy Ltd, Turku (FI)

( * ) Notice: Subject to any disclaimer, the term of this patent is extended or adjusted under 35 U.S.C. 154(b) by 130 days.

(21) Appl. No.: 13/699,277

(22) PCT Filed: May 24, 2011

(86) PCT No.: PCT/FI2011/050473

§ 371 (c)(1),
(2), (4) Date: Nov. 20, 2012

(87) PCT Pub. No.: WO2011/148055

PCT Pub. Date: Dec. 1, 2011

(65) Prior Publication Data

US 2013/0064739 A1 Mar. 14, 2013
US 2013/0309148 A2 Nov. 21, 2013

(30) Foreign Application Priority Data

May 26, 2010 (FI) ..... 20105591

(51) Int. Cl.
*B01L 3/14* (2006.01)
*B01L 3/00* (2006.01)

(52) U.S. Cl.
CPC ..... *B01L 3/50* (2013.01); *B01L 2200/142* (2013.01); *B01L 2300/0887* (2013.01); *B01L 3/50853* (2013.01); *B01L 2200/141* (2013.01); *B01L 3/50825* (2013.01); *B01L 2300/044* (2013.01); *B01L 2200/0689* (2013.01)
USPC ..... 422/550; 422/547; 422/551; 422/552; 422/568

(58) Field of Classification Search
CPC ..... B01L 3/00; B01L 3/14; B01L 3/50; B01L 3/508; B01L 3/50853; B01L 2300/0829; B65D 41/20; B65D 51/00; B65D 51/002
USPC ..... 422/547, 550, 551, 552, 553, 568, 569
See application file for complete search history.

(56) References Cited

U.S. PATENT DOCUMENTS 5,227,139 A 7/1993 Wong ..... 422/103
5,516,490 A 5/1996 Sanadi ..... 422/101

(Continued)

FOREIGN PATENT DOCUMENTS

EP 1 364 710 11/2003
EP 1 972 377 9/2008

(Continued)

*Primary Examiner* — Jill Warden
*Assistant Examiner* — Dwayne K Handy
(74) *Attorney, Agent, or Firm* — James C. Lydon

(57) ABSTRACT

The invention relates to a piercable hermetic cover (2) for a bioassay cartridge (4) with at least one reaction chamber (6). Characteristic for the invention is that: the cover (2) comprises at least a top layer (8), a middle layer (10), a bottom layer (12), and sites intended for piercing (14); and the cover (2) has, at the sites (16) intended for piercing, a hollow space (18) between the top layer (14) and the bottom layer (12). The present invention also relates to a system (20) comprising a bioassay cartridge (4) and a cover (2) for the cartridge (4). The present invention further relates to use of the cover (2) for covering the cartridge (4).

16 Claims, 7 Drawing Sheets

(56) References Cited

U.S. PATENT DOCUMENTS

| | | | | |
|---|---|---|---|---|
| 2001/0041336 | A1* | 11/2001 | Anderson et al. | 435/6 |
| 2004/0235036 | A1 | 11/2004 | Beutler et al. | 435/6 |
| 2008/0152545 | A1 | 6/2008 | Anderson et al. | 422/102 |
| 2012/0064614 | A1 | 3/2012 | Broyer et al. | 435/287.2 |

FOREIGN PATENT DOCUMENTS

| | | |
|---|---|---|
| FR | 2 938 063 | 5/2010 |
| WO | WO 00/03805 | 1/2000 |

* cited by examiner

SEALING OF REACTION CUVETTES FOR BIOAFFINITY ASSAYS

FIELD OF THE INVENTION

The invention relates to in vitro diagnostic testing of analytes from biological or clinical samples. In more detail, the invention relates to near-patient in vitro diagnostic testing of clinical samples which apply bioaffinity binding reactions. In particular, the invention relates to sealing of reaction cuvettes containing dried reagents for bioaffinity assays.

BACKGROUND OF THE INVENTION

The publications and other materials used herein to illustrate the background of the invention, and in particular, cases to provide additional details respecting the practice, are incorporated by reference.

Trends in Diagnostic Testing

Wide variety of methods and instruments are commercially available for in vitro immunodiagnostic (IVD) testing of clinical samples. Traditional IVD tests, such as ELISA immunoassay tests, are characterized with complicated test methodology. A test may need addition of reagents in several steps and washing in several steps. This makes the tests laborious to perform. In order to reduce the need of labour, automated analysers have been developed. The analysers can work either in "random-access mode" or in "batch mode". The automated analysers can run up to several hundreds of tests an hour. Typically, the larger the analyser, the higher the test capacity is. The test menu of an automated random-access analyser can contain tests up to 50 different analytes, or even more. By the economy of size, a large analyser can provide results cheaper than a small analyser. This has pushed IVD testing towards large centralized laboratories.

The main drawback of centralized testing is the long turn-around-time, which is far too long to satisfy the testing need of acute patient cases. Therefore, the trend of centralization has been followed by the trend of near-patient-testing, i.e. point-of-care testing. At the point-of-care, there is an increasing need for test instruments which provide rapid results. To be applicable in the point-of-care, the instrument should be easy to use, small in size, and affordable in price.

In order to meet with the requirements of point-of-care testing, the test methodology should be as simple as possible. A widely used approach for simplifying the test methodology is to apply dried (or lyophilised) biochemical reagents in place of liquid reagents. The use of dried reagents can eliminate the steps of reagent addition.

Another approach to simplify test methodology is to apply a detection technology which allows separation-free (wash-free) detection of bioaffinity assays. The use of a separation-free detection technique can eliminate washing steps.

An approach to reduce the size of the analyser is to reduce reaction volumes, i.e. to miniaturize the testing system. This also reduces volumes of test consumables, such as test reagents and buffers. This makes the test better suited for point-of-care use. Miniaturizing, however, usually compromises the performance figures of the detection technique. To avoid this, a detection technique which tolerates miniaturization without compromising performance should be used.

Dried Reagents

It is widely known that bioaffinity reagents, such as antibodies, antigens and enzymes, retain biological activity very well in the dried state. In the dried condition, the reagents are usually stable for storage even in room temperature. Thus, there is no need to maintain a strict cold chain in reagent supply logistics. This reduces costs of shipping and storage. Dried reagents also allow the design of simpler test instruments for point-of-care use.

It is also of common knowledge that the dried bioaffinity reagents must be kept hermetically closed to avoid contact with ambient moisture. Upon exposure to moisture, the dried reagents tend to loose biological activity, which leads to decrease in assay performance. In case the assay reagents are dried in the final reaction cuvette, the reaction cuvette must be sealed hermetically to avoid contact with ambient humidity. Most often this is realized with an adhesive metal foil. To improve the mechanical properties, the foil can be composed of several co-layers of variable materials. A common type of foil is composed of a plastic layer and a metal foil layer. The plastics layer makes the foil more durable and flexible. In case hermetic sealing is not needed, the reaction cuvette can be sealed with a bare plastic film to protect from dust and other occasional spillovers.

In a typical automated IVD analyser using dried reagents, the clinical sample can be dispensed through the cover foil to the reaction cuvette by a dispensing needle. The dispensed sample dissolves the dried reagents, and triggers the binding reaction between the analyte and the reagents. Mixing or shaking of the reaction cuvette is often needed to accelerate dissolution of the reagents and to enhance reaction kinetics. In point-of-care settings, fast reaction kinetics is essential due to the requirement for a short turn-around-time. In most analysers, subsequent processing of the reaction well is usually needed, such as washing of the unbound components and addition of components that allow quantitation of immunoassay binding degree (e.g. substrate or enhancement solution). Thus, the well needs to be accessed several times.

Shaking of open reaction cuvettes tends to cause spill over and aerosol formation, which can lead to contamination of proximate reaction cuvettes. This can cause false test results, and deteriorate both accuracy and imprecision of the test method. Mechanical mixing is thus associated with a significant carry over risk.

In case of miniaturized test systems where the reaction volume is small, evaporation of the solvent from an open cuvette may also play a role to a significant degree. In such a case the actual concentrations increase, which distorts the assay results. In miniaturized systems, the effects of spill over and aerosol formation are pronounced in comparison to conventionally sized cuvettes.

Evaporation and spilling caused by shaking could be avoided by sealing of test cuvettes after dispensing of the sample. Sealing of the cuvettes, however, would complicate the manual test protocol or, if the method was automated, it would significantly complicate the design of the analyser. In conclusion, a sealing step should be avoided to make the analyser suited for routine IVD use at the point-of-care.

If the cuvette was covered with a foil (or other type of cover) and the dispensing of the samples is carried out through the foil with a thin dispensing needle, probability for spilling would be decreased when compared to open cuvettes. In such a case, the probability of spilling would be proportional to the diameter of the piercing needle. However, even in this case, spilling is very likely to occur during shaking and significant evaporation is likely to occur during incubation. These can deteriorate assay performance.

Re-Sealable Piercable Covers

In order to overcome the problems described above, the cuvettes could be sealed with a re-sealing piercable cover. Many kind of re-sealing covers are known in the art. These covers can be made of plastic films or of flexible materials, such as rubber, silicon, and other elastomers. Such covers are widely applied to cover, for example, reaction vials of nucleic acid amplification reactions, such as thermocycled PCR reactions. In these, the sealing is typically pierced after the cycling to aspirate the liquid. These covers, however, are hardy applicable to miniature reaction cuvettes, such as microtitration wells of the 384 well format. One of the major obstacles with such elastomer covers is the increase of air pressure in the cuvette due to the dispensing. In order to avoid the increased pressure, an equivalent volume of air should flow out of the cuvette. In case of a rubber or a silicon cover, the dispensing needle sits tightly in the pierced opening, and does not let air flow out. The increased pressure impairs the accuracy of dispensing, or it can fail the dispensing completely. In conclusion, piercable covers made of moulded rubber, silicon, or other resilient/elastic bulk material, are not well suited to cover small volume reaction cuvettes.

The problems of increased pressure can be overcome by pre-scoring (pre-slitting) the sealing material at the expected piercing point. Pre-scoring can be of linear shape, Y-shape, or cross-shape or other. Upon piercing with a needle, the edges of the score would bend downwards, thus opening a cleavage for free air outflow. After retraction of the needle, the edges must revert to their original position to close the opening properly. Therefore, the cover material must be elastic and/or resilient. Complete pre-scoring of the cover material allows free diffusion of ambient gases to the cuvette, thus closing is not hermetic. Accordingly, completely pre-scored sealers are not applicable as such with dried reagents.

The elastic cover, whether pre-scored or not, can be topped with a metal layer to keep the cover hermetic until pierced with a needle. Such cover materials are commonly used to pouch microtitration plates, strips and other moisture sensitive bioassay consumables. The metal layer, however, is inelastic. Thus it resists the bending of the slit edges. Once the edges are bent down due to piercing, the metal layer resists recovery of the edges to their original position. In other words, the metal foil disturbs proper reversible function of the pre-scored elastomer cover. If the opening does not close properly, it can lead to spilling or evaporation of the reaction mixture. This again deteriorates method performance.

None of the prior art methods for sealing of reaction cuvettes fulfil criteria for being:

(i) hermetic during storage
(ii) allowing accurate dispensing with a piercing needle
(iii) allowing outflow of air during dispensing
(iv) reversibly closing the pierced opening to avoid spilling and evaporation

OBJECT AND SUMMARY OF THE INVENTION

One object of the present invention is to provide a piercable hermetic cover for a bioassay cartridge with reaction chambers.

Another object of the present invention is to provide a system comprising a bioassay cartridge with reaction chambers and a cover for said cartridge.

A further object of the present invention is to provide use of the piercable hermetic cover.

Thus the present invention provides a piercable hermetic cover for a bioassay cartridge with at least one reaction chamber. Characteristic for the cover is that a) said cover comprises at least a first layer, i.e. a top layer, a second layer, i.e. a middle layer, a third layer, i.e. a bottom layer, and a site or sites intended for piercing;
b) when said cartridge is covered with said cover said third layer is against said cartridge, and said site or sites intended for piercing is at the opening of the reaction chamber or are at openings of the reaction chambers; and
c) said cover has, at the site or sites intended for piercing, a hollow space between said first layer and said third layer, i.e. said second layer has a hole extending through said second layer.

The present invention also provides a system comprising a bioassay cartridge comprising at least one reaction chamber and a cover for said cartridge. Characteristic for the system is that the cover is the cover of the invention as defined above.

The present invention further provides a use of the cover according to the invention as defined above for covering a bioassay cartridge.

DETAILED DESCRIPTION OF THE INVENTION

The invention provides a new design for sealing of low volume bioaffinity assay cartridges. The design is especially suitable for assays on random-access analyzers where samples to be dispensed into one or parallel reaction chambers are inserted at irregular intervals for analysis and it is important that reaction chambers to be used later remain hermetic. The new design allows manufacturing of ready-to-use bioassay cartridges with low volume reaction chambers, which (i) contain bioaffinity reagents in a dried state
(ii) are kept hermetically closed during storage
(iii) allow accurate dispensing to the chamber with a piercing needle
(iv) allow free outflow of air from the chamber during dispensing
(v) ensure reversibly closing of the needle track upon retraction
(vi) eliminate cross-contamination caused by occasional spillovers Typical characteristics of the new sealing design are as follows:

(i) the sealing has a pre-scored bottom layer made of resilient material
(ii) the sealing has a hermetic top layer, and
(iii) the sealing has a hollow/spacious middle layer The hollow middle layer is the gist of the invention. A sealing according to this invention overcomes the obstacles of prior art, and allows manufacturing of ready-to-use low volume bioassay cartridges fulfilling the four criteria listed above.

According to the invention, a hollow middle layer separates the bottom layer from the top layer. The middle layer provides space between the top and the bottom layers, and keeps the two layers at an essentially constant distance from each other.

The hollow middle layer is essential for proper functioning of the cover. Without the hollow middle layer, the cover does not meet imperative requirements for ready-to-use low volume bioassay cartridges.

Figure 1:
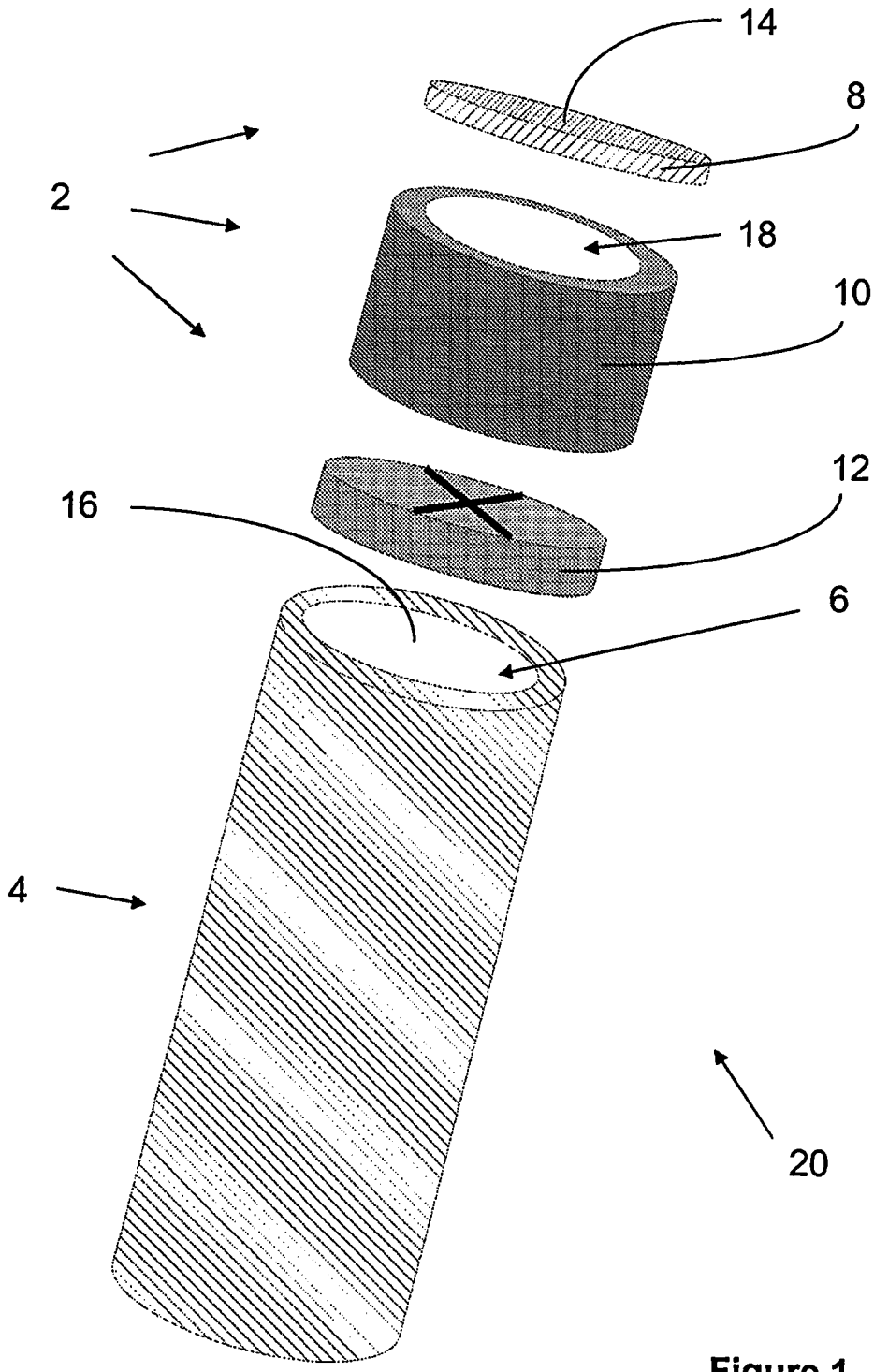
FIG. 1 schematically shows, with an exploded view of the cover, a single well bioassay cartridge system according to the invention.

The structure of a typical cover according to the invention is shown in FIG. 1. The thickness of the hollow layer is typically 0.2 mm in minimum. Preferred thickness is at least 0.5 mm. If the thickness is too small, the layer gradually loses its effect to resist consequences of spilling. There is in principal no maximum thickness for the middle layer. Due to practical reasons, however, a preferred thickness is 10 mm in maximum. The most preferred thickness is from 1 to 5 mm.

The middle layer is hollow at the point of piercing. The hollow space can have the shape of a cylinder, cone, cut cone or cube, or any other shape. The volume of the hollow space is proportional to the thickness of the layer, and it depends on the shape of the hollow space. Typically the volume is no smaller than 5% of the volume of the cartridge cavity, i.e. the reaction chamber. If the volume is too small, the layer loses its effect in resisting consequences of spilling and ability to allow free operation of the bottom and the top layers. There is no upper limit for the space volume, but for practical reasons the volume should not exceed the volume of the cartridge cavity by more than 10 fold.

The hollow middle layer is attached on the top side to the top layer. The top layer can be whatever material which is piercable with a needle and is hermetic until piercing. After piercing it is no longer hermetic. The top layer can be composed of metal foil or plastic-metal bilayer or of other composition. The composition and dimensions of the top layer does not limit the scope of the invention.

The hollow middle layer is below attached to the bottom layer. The bottom layer is any elastic or flexible material which is piercable with a needle and allows air to flow out from the cartridge during dispensing. The bottom layer can be solid or pre-scored prior to piercing. The bottom layer can be composed of any elastic or flexible material such as plastic film, cell foam, polyurethane, rubber, silicon or other material, provided that when pierced with a needle, the pierce joint is not air tight, but allows air to freely flow out from the cartridge cavity.

Terms

Terms used in this application can be defined as follows:

Piercable hermetic cover. In the context of the present invention the term piercable hermetic cover refers to a cover of bioassay cartridge that seals reaction chambers of the cartridge. Referral to that the cover is hermetic means that the cover, before being pierced, does not allow any flow or diffusion of matter to or from a reaction chamber through the cover. Accordingly in the context of this application the hermetic cover ensures that the dried reagents, typically dried or lyophilized, do not deteriorate due to flow or diffusion of matter, typically water vapour, into the reaction chamber through the cover, not even during prolonged storage, i.e. storage lasting for at least several weeks, preferably months. Referral to piercable means that the cover can be pierced with a dispensing needle for insertion of sample and optionally a buffer for dilution together with, and/or in addition to reagents.

Bioassay cartridges: In the context of the present invention the term bioassay cartridge refers to any cartridge, whether a single tube, a multi reaction well strip (e.g. 12 wells) or a multi well plate (e.g. 96 or 384 wells). In the context of this application the term typically refers to cartridges for bioassays wherein the volume of the reaction chambers are from 5 μl to 2 ml, preferably from 5 μl to 50 μl, 50 μl to 500 μl or 500 μl to 2 ml, and most preferably from 10 μl to 30 μl.

First layer/Top layer. In the context of the present invention referral to first layer and top layer of the cover of the bioassay cartridge refers to the layer of the cover which is on top of the other layers defined in the application, i.e. the layer being on top of the middle layer being on top of the bottom layer, of the cover when the cover seals the cartridge.

Second layer/Middle layer. In the context of the present invention referral to second layer and middle layer of the cover of the bioassay cartridge refers to the layer of the cover being in between the top layer and the bottom layer of the cover. It should be noted that the middle layer of the cover can be a continuation of the top and/or bottom layer as long as a middle layer, between the top layer and the bottom layer can be defined such that the middle layer comprises a hollow space or hollow spaces between said first layer and said third layer, i.e. said second layer has a hole or holes extending through said second layer at the site or sites, respectively, intended for piercing.

Third layer/Bottom layer. In the context of the present invention referral to third layer and bottom layer of the cover of the bioassay cartridge refer to the layer of those defined in the invention, being against, i.e. closest to the reaction chamber in particular the opening of the reaction chamber when the cartridge is covered with the cover, e.g. sealed with the cover.

Site/Sites intended for piercing: In the context of the present invention referral to site intended for piercing and sites intended for piercing refer to sites, i.e. particular areas, of the surface of the cover or surface of a particular layer of the cover of the bioassay cartridge through which piercing for insertion of sample and optionally a buffer for dilution together with, and/or in addition to reagents is carried out when the cartridge is used, i.e. the bioassay is carried out. The site or sites intended for piercing are at the opening of the reaction chamber or at the openings of the reaction chambers of the bioassay cartridge when the cartridge is covered with said cover, e.g. when sealed with the cover.

Hollow space/thickness of hollow space/width of hollow space: In the context of the present invention the term hollow space refers to the holes of the middle layer of the cover of the bioassay cartridges. The hole extends through the second layer from the first layer to the third layer. Accordingly, the holes are limited by the top layer on top, the middle layer on the sides and the bottom layer on the bottom. The term thickness of the hollow space refers to the distance from the first layer to the second layer over the hollow space. The thickness is typically measured parallel to the intended axis of piercing. The intended axis of piercing is typically perpendicular to the plane of the cover. The thickness of the hollow space is equal to the thickness of the middle layer provided the thickness of the middle layer is constant, which preferably is the case. The term width of hollow space refers to the dimension of the hollow space perpendicular to the intend axis of piercing and typically parallel to the plane of the cover. The width of the hollow space can vary in relation to the distance from the top layer and/or bottom layer depending on the form of the hollow space. If the form is e.g. that of a cone or a cut cone the width of the hollow space depend on at which end of the cone or cut cone it is measured.

Reaction chamber/volume of reaction chamber. In the context of the present invention the term reaction chamber refers to the space limited by the walls of reaction chamber, typically the tube or well, and the plane of the cover covering the bioassay cartridge. Accordingly the volume of the reaction chamber refers to the total volume of the chamber wherein the reaction of the bioassay is to take place. Thus the volume as well is limited by the walls of reaction chamber, typically the tube or well, and the plane of the cover covering the bioassay cartridge. Typical volumes of reaction chamber of the present invention are from 5 μl to 2 ml, preferably from 5 μl to 50 μl, 50 μl to 500 μl or 500 μl to 2 ml, and most preferably from 10 μl to 30 μl.

Pierce joint: In the context of the present invention the term pierce joint refers to the joint of the needle pierced through the cover or a particular layer of the cover. Typically the pierce joint through either the top layer or bottom layer or both, preferably at least the bottom layer, is not gas tight but allows gas to freely flow out from the reaction chamber when the sample and optionally a buffer for dilution together with, and/or in addition to reagents is dispensed into the reaction chamber.

Needle track/tight closing of needle track: In the context of the present invention the term needle track refers to the track through the cover or a particular layer of the cover left by piercing needle after it has been retracted. Typically at least either the needle tract through the top layer or the bottom layer closes tightly upon retraction of the needle. The term closes tightly in the context of the present invention means that the closure is such that no significant flow of matter, i.e. flow of matter that could significantly affect the performance of the bioassay carried out, occurs through the needle tract that is tightly closed during the bioassay.

Preferable Embodiments of the Invention

A typical embodiment of the invention comprises a piercable hermetic cover for a bioassay cartridge with at least one reaction chamber wherein a) said cover comprises at least a first layer, i.e. a top layer, a second layer, i.e. a middle layer, a third layer, i.e. a bottom layer, and a site or sites intended for piercing;
b) when said cartridge is covered with said cover said third layer is against said cartridge, and said site or sites intended for piercing is at the opening of the reaction chamber or are at openings of the reaction chambers; and
c) said cover has, at the site or sites intended for piercing, a hollow space between said first layer and said third layer, i.e. said second layer has a hole extending through said second layer.

In typical embodiments of the present invention the cover, before being pierced, does not allow any flow or diffusion of matter to or from a reaction chamber through the cover.

In most typical embodiments of the present invention the volume of each hollow space at each site of piercing is from 5% of to 10 fold, preferably 15% of to 3 fold and most preferably 50% of to 2 fold the volume of the corresponding reaction chamber of the cartridge. In many typical embodiments the thickness of the hollow space, i.e. the distance between the first layer and the second layer over the hollow space, is from 0.1 mm to 20 mm, preferably from 0.3 mm to 10 mm and most preferably from 1 mm to 5 mm; and/or the width, measured essentially perpendicular to the intended axis of piercing, of the hollow space at the site of piercing is from 1.5 mm to 2 fold, preferably from 2 mm to 1.5 fold and most preferably from 2.5 mm to 1 fold the width of the opening of the reaction chamber covered with said cover.

In most embodiments of the invention either the first layer or the third layer, preferably said first layer, of the cover is hermetic until piercing; and either the third layer or first layer, respectively, preferably said third layer, is such, that i) when being pierced by a needle, the pierce joint is not gas tight but allows gas to freely flow out from the reaction chamber, and
ii) said layer ensures tight closing of the needle track upon retraction of said needle.

In many embodiments of the invention the layer, either the first layer or the third layer, preferably said first layer, with a pierced joint not being gas tight, when being pierced by a needle, but allowing gas to freely flow out from the chamber, is pre-scored. Preferably pre-scoring is +-shaped (i.e. cross-shape), X-shaped, Y-shaped or I-shaped (i.e. linear).

In some preferred embodiments of the invention the cover comprises at least one further layer. The further layer or layers can be above, between, or below the first, second and/or third layers. In some preferred embodiments the cover comprises one further layer above, i.e. on top of, the first layer and said further layer has, at the site or sites intended for piercing, a hollow space.

A typical system according to the invention comprises a bioassay cartridge with at least one reaction chamber and a cover for said cartridge wherein the cover is according to the present invention as defined above. In most typical embodiments of the system the volumes of the reaction chambers of the bioassay cartridge are from 5 μl to 2 ml, preferably from 5 μl to 50 μl, 50 μl to 500 μl or 500 μl to 2 ml, and most preferably from 10 μl to 30 μl.

The invention further involves use of the cover according to the present invention as defined above. In most typical embodiments of use the volumes of the reaction chambers of the bioassay cartridge are from 5 μl to 2 ml, preferably from 5 μl to 50 μl, 50 μl to 500 μl or 500 μl to 2 ml, and most preferably from 10 μl to 30 μl.

EXAMPLES

The invention is illustrated by examples 1-7 as follows, however, the applications where this invention provides advantages are not limited to these examples.

Example 1

Single Well Reaction Chamber

FIG. 1 shows a bioassay cartridge 4 with a single well reaction chamber 6 sealed with a three layer 8, 10, 12 cover 2. The bottom layer 12 of the cover 2 is made of 3 mm thick silicon, pre-scored (X-shape) at the point of expected piercing. The hollow space 18 of the middle layer 10 is cylinder in shape, 10 mm in diameter, 10 mm in depth. The bottom layer 10, i.e. the backbone around the hollow space 18, uniting the top layer 8 and the bottom layer 12, is made of closed-cell polyethene foam. The top layer 8 is hermetic, made of metal foil, 80 μm in thickness. The tube 4 is packed with dried reagents. The reagent cartridge 4 is stored in a metal foil pouch until used for assay.

The cartridge 4 is used for a bioassay. A sample is added into the reaction chamber 6 with a dispensing needle. The needle is pierced through the three-layer cover 2, dispensing the sample volume into the reaction chamber 6, and then retracted from the chamber 6. This cover 2 design brings the essential advantages of the invention.

Example 2

Multiwell Cartridge, 12 Reaction Wells

Figure 2:
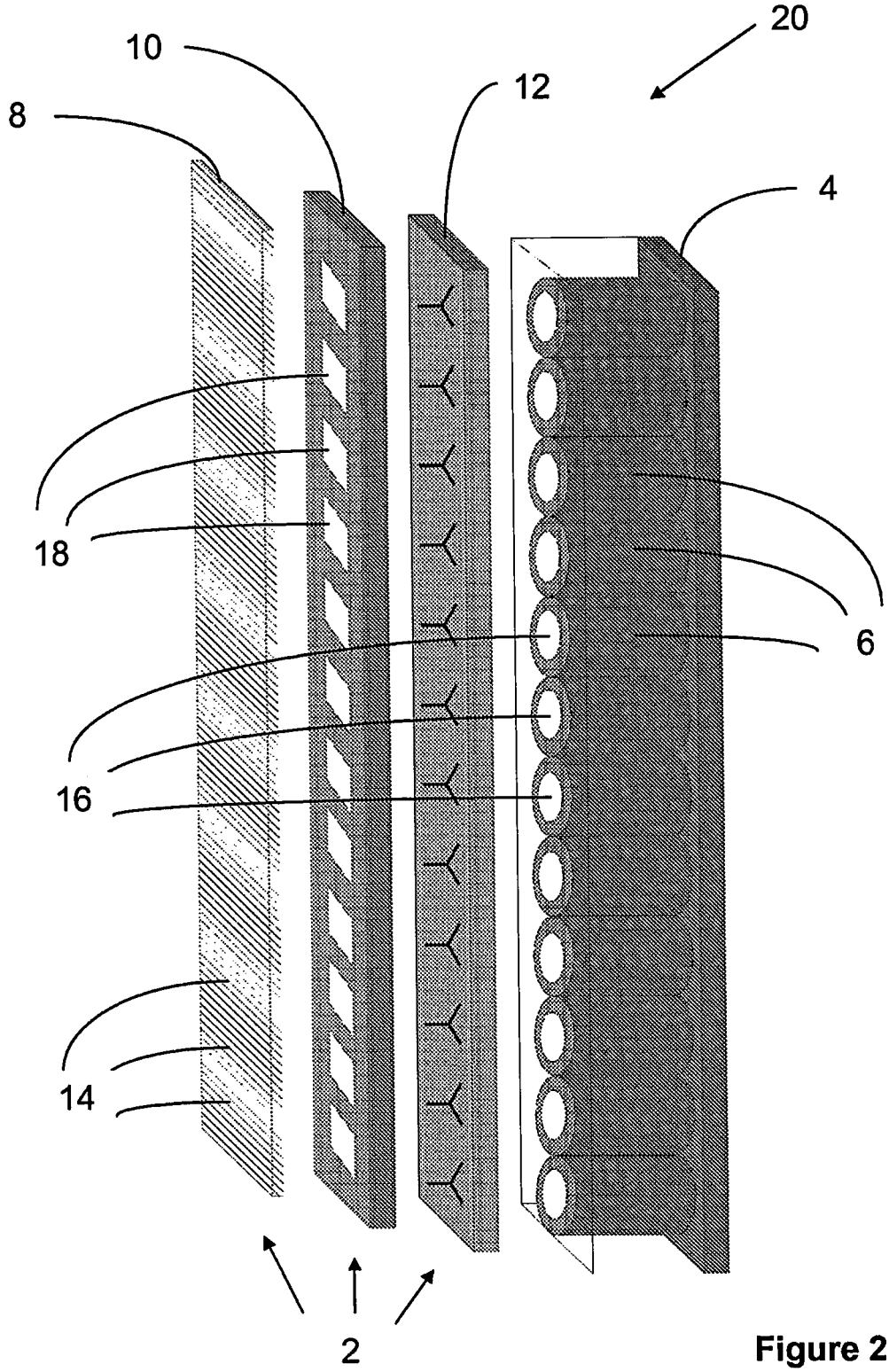
FIG. 2 schematically shows, with an exploded view of the cover, a 12-well bioassay cartridge system according to the invention.

FIG. 2 shows a system 20 comprising a multiwell cartridge 4 composing of 12 reaction wells 6 in an array sealed with a three layer 8, 10, 12 cover 2. The bottom layer 12 of the cover 2 is made of 2 mm closed-cell neoprene foam, pre-scored (Y-shape) at the point of expected piercing. The hollow space 18 of the middle layer 10 is cuboid in shape (6 mm×6 mm), and 2 mm in depth. The middle layer 10, i.e. the backbone around the hollow space 18, uniting the top layer 8 and the bottom layer 12, is made of closed-cell rubber foam. The top layer 8 is hermetic, made of plastic laminated metal(bilayer) 120 μm in thickness. The reaction chambers 6 are packed with dried reagents.

The cartridge 4 is used for a bioassay. The sample is added into the reaction chamber 6 with a dispensing needle. The needle is pierced through the three-layer 8, 10, 12 cover 2, dispensing the sample volume into the reaction chamber 6, and then retracted from the chamber 6. This cover 2 design brings the essential advantages of the invention.

Example 3

Multiwell Cartridge, 96 Reaction Wells

Figure 3:
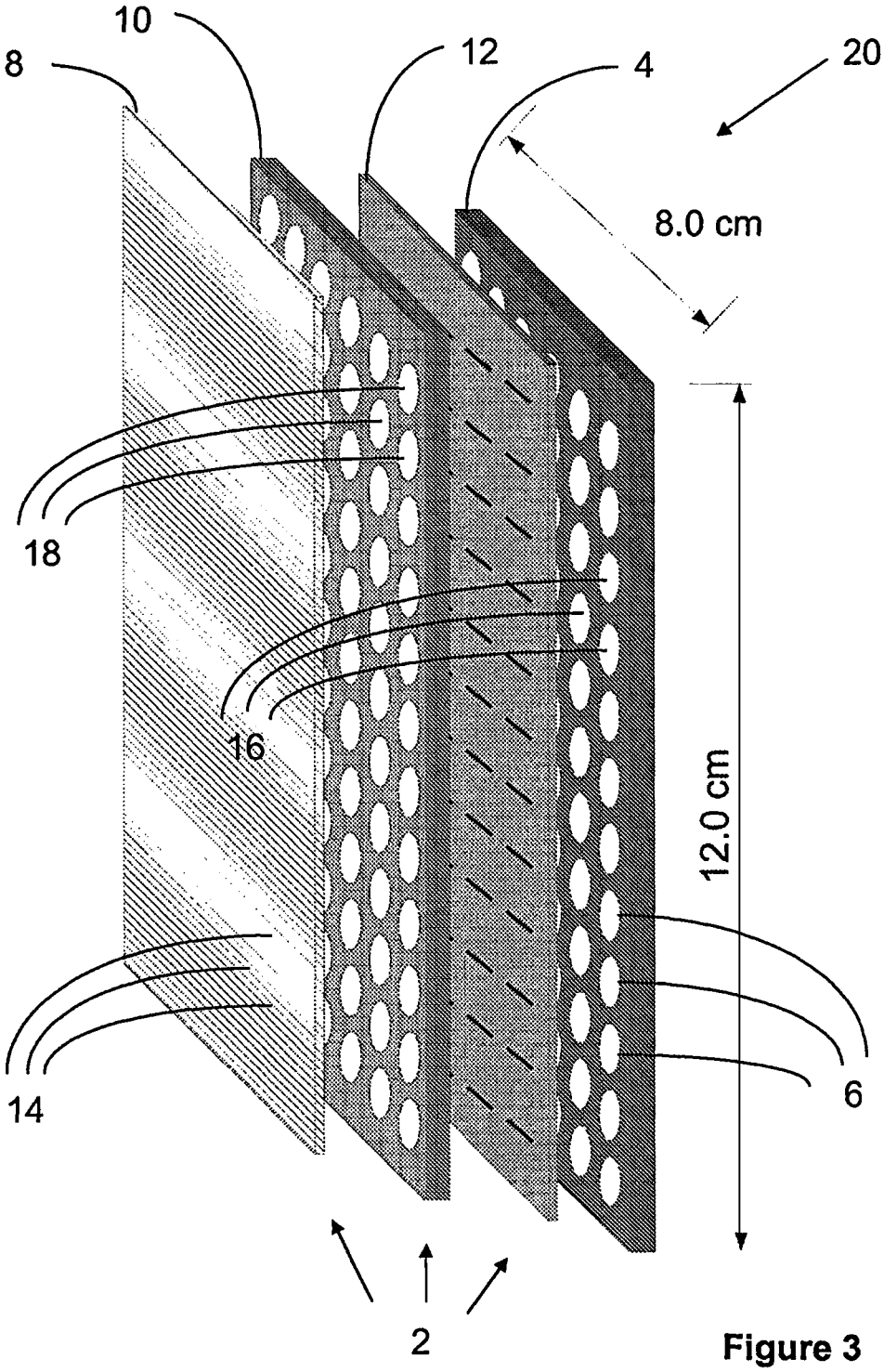
FIG. 3 schematically shows, with an exploded view of the cover, a 96-well bioassay cartridge system according to the invention.

FIG. 3 shows a system 20 comprising a multiwell cartridge 4 composing of 96 reaction wells 6, made of a standard 96-well plate 20 which cartridge 4 is sealed with a three-layer 8, 10, 12 cover 2. The bottom layer 12 of the cover 2 is made of 100 μm thick vinyl, is pre-scored (I-shape) at the point of expected piercing. The hollow space 18 of the middle layer 10 is conical in shape, 5 mm in diameter, 1 mm in depth. The middle layer 10, i.e. the backbone around the hollow space 18, is made of polyurethane. The top layer 8 is hermetic, made of metal foil 15 μm in thickness. The cartridge system 20 is packed with dried reagents. The reagent cartridge system 20 is stored in a metal foil pouch until used for assay.

The cartridge system 20 is used for a bioassay. The sample is added into the reaction chamber 6 with a dispensing needle. The needle is pierced through the three layer 8, 10, 12 cover 2, dispensing the sample volume in the reaction chamber 6, and then retracted from the chamber 6. This cover 2 design brings the essential advantages of the invention.

Example 4

Multiwell Cartridge, 384 Individual Reaction Wells

Figure 4:
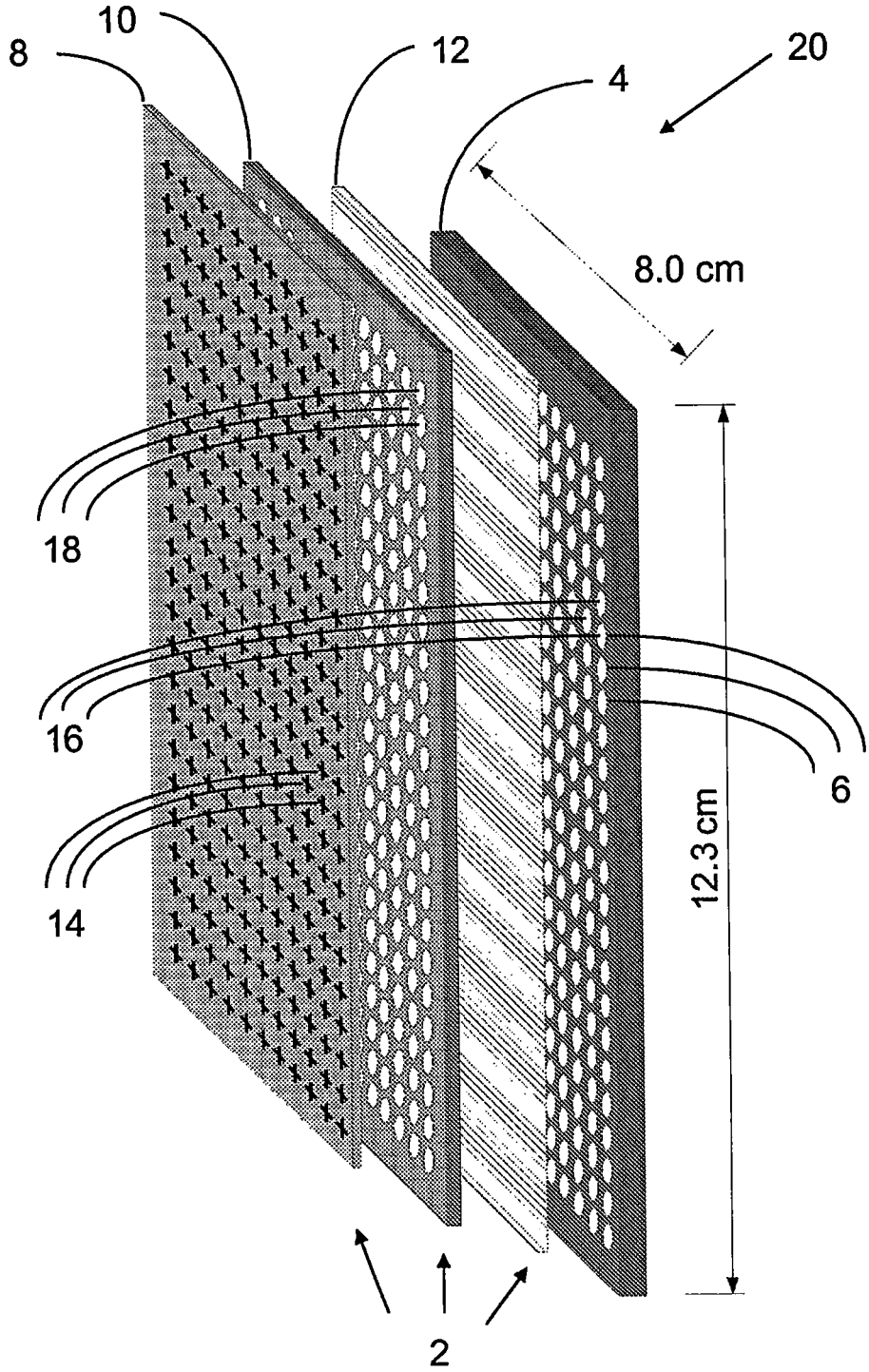
FIG. 4 schematically shows, with an exploded view of the cover, a 384-well bioassay cartridge system according to the invention.

FIG. 4 shows a multiwell cartridge system 20 composing of 384-individual reaction chambers 6, made of a standard 384-well plate 4 sealed with a three-layer 8, 10, 12 cover 2. The bottom layer 12 of the cover is hermetic, made of metal foil 50 μm in thickness, the top layer 8 made of polyurethane cell foam is pre-scored (+-shape) at the point of expected piercing 14 and 0.5 mm in thickness. The metal layer 12 is not pre-scored. The hollow space 18 of the middle layer 10 is cylinder in shape, 2 mm in diameter, 0.5 mm in depth. The middle layer 10, i.e. the backbone around the hollow space 18, is made of closed-cell foam. The system 20 is packed with dried reagents.

The cartridge system 20 is used for a bioassay. The sample is added into the reaction chamber 6 with a dispensing needle. The needle is pierced through the three layer 8, 10, 12 cover 2, dispensing the sample volume in the reaction chamber 6, and then retracted from the chamber. This cover 2 design brings the advantages of the invention.

Example 5

Multiwell Cartridge, 384 Individual Reaction Wells

Figure 5:
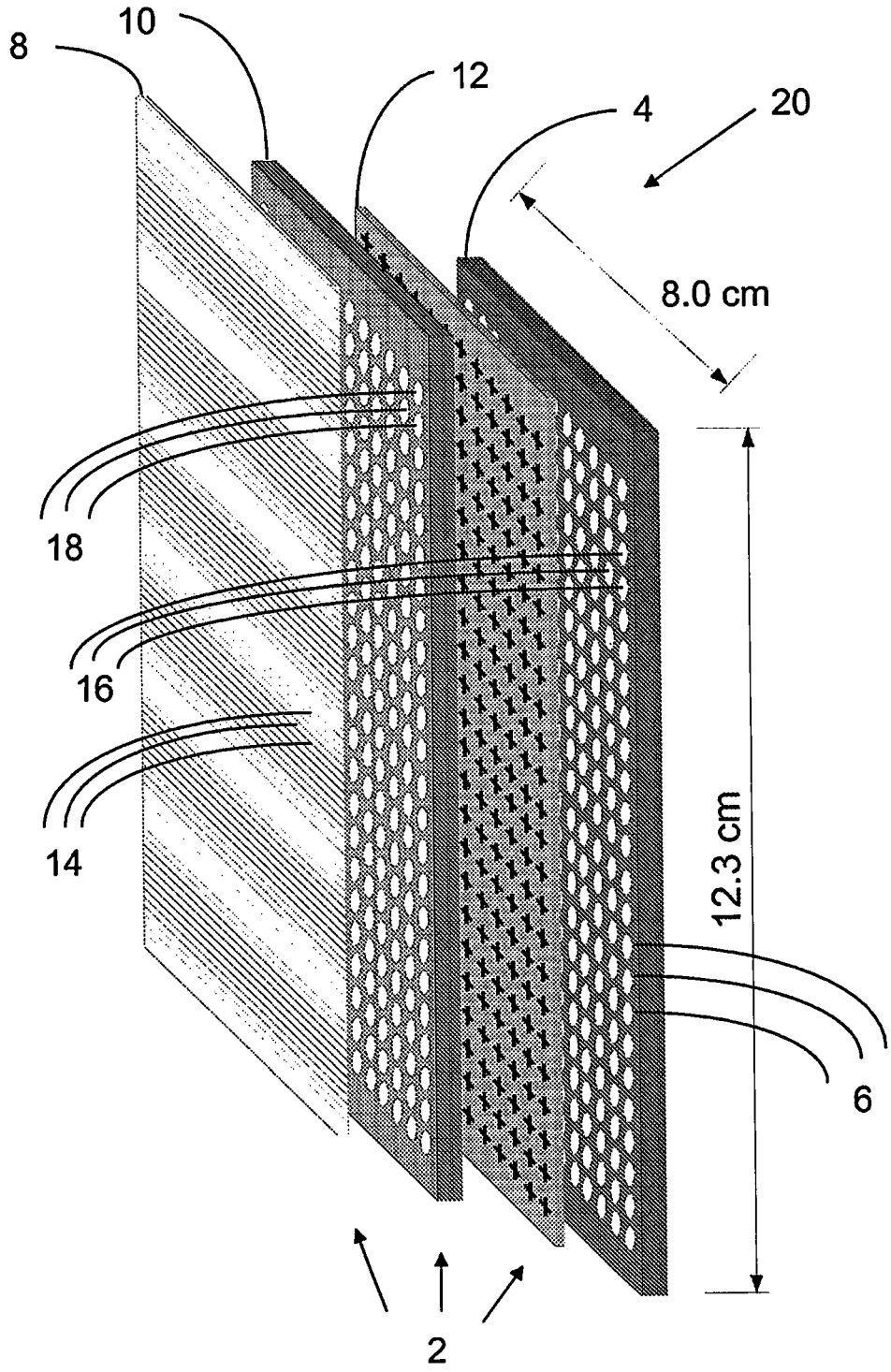
FIG. 5 schematically shows, with an exploded view of the cover, another 384-well bioassay cartridge system according to the invention.

FIG. 5 shows a multiwell cartridge system 20 composing of 384 individual reaction chambers 6, made of a standard 384-well plate 4 sealed with a three-layer 8, 10, 12 cover 2. The bottom layer 12 of the cover 2 is made of 300 μm closed-cell polyurethane foam—polyethene bilayer, pre-scored (+-shape) at the point of expected piercing. The hollow space 18 of the middle layer 10 is cylinder in shape, 3 mm in diameter, 2 mm in depth. The middle layer 10, i.e. the backbone around the hollow space 18, is made of closed-cell foam. The top layer 8 is hermetic, made of aluminium foil, 30 μm in thickness. The system 20 is packed with dried reagents.

The cartridge system 20 is used for a bioassay. The sample added into the reaction chamber 6 with a dispensing needle. The needle is pierced through the three-layer 8, 10, 12 cover 2, dispensing the sample volume into the reaction chamber 6, and then retracted from the chamber 6. This cover 2 design brings the essential advantages of the invention.

Example 6

Multiwell Cartridge, 384 Individual Reaction Wells

Figure 6:
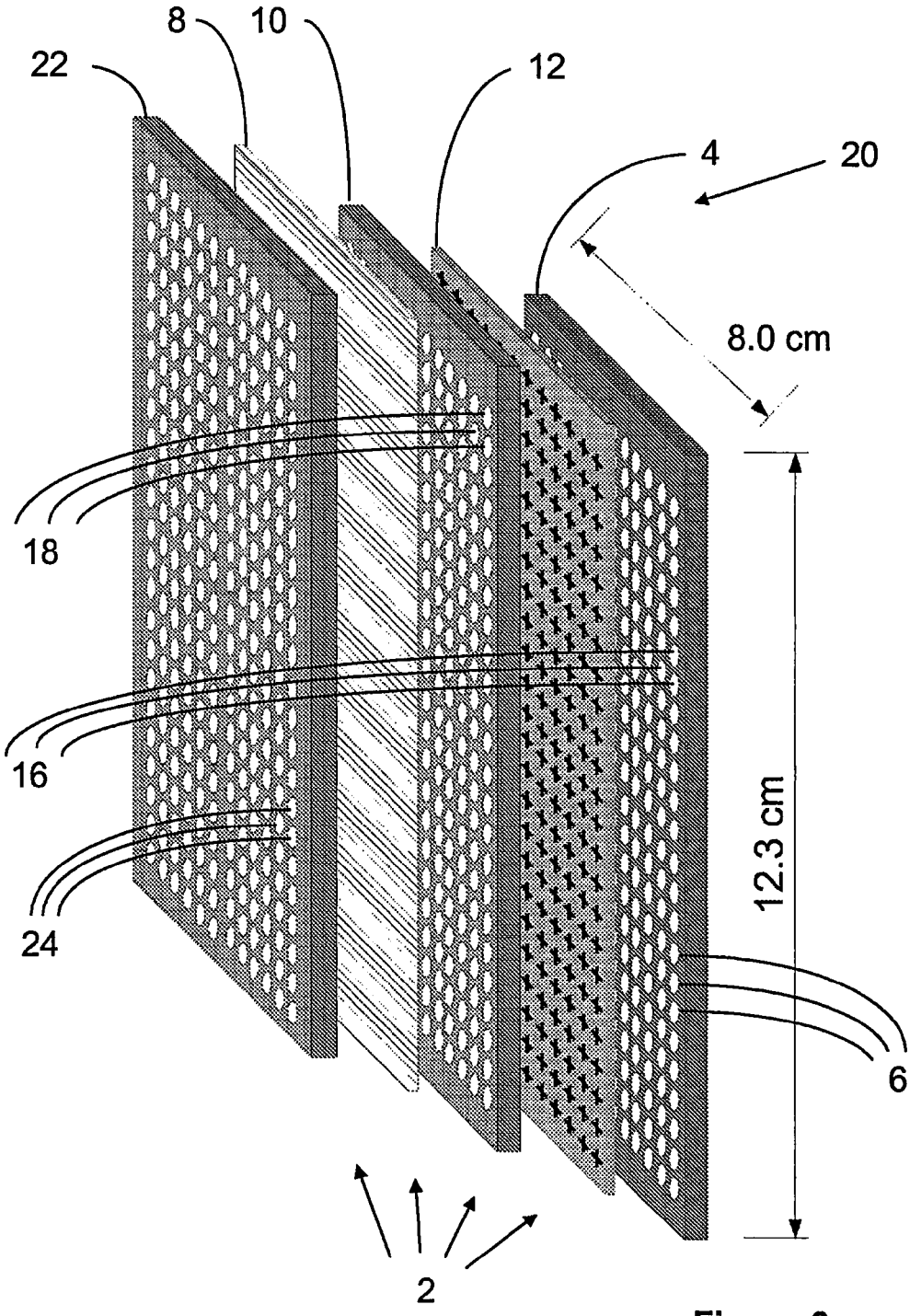
FIG. 6 schematically shows, with an exploded view of the cover, a further 384-well bioassay cartridge system according to the invention.

FIG. 6 shows a multiwell cartridge system 20 otherwise identical to that of Example 5, but which has on an additional layer 22, similar to the middle layer 10 on top of the top layer 8. The additional layer 22 can, in some embodiments, improve performance by more efficiently segregating the sites intended for piercing. Thus, in case of spillage at the site of piercing the risk of the spillage being carried over to other sites of piercing is greatly reduced.

The cartridge system 20 is used for a bioassay. The sample added into the reaction chamber 6 with a dispensing needle. The needle is pierced through the four-layer 22, 8, 10, 12 cover 2, dispensing the sample volume into the reaction chamber 6, and then retracted from the chamber 6. This cover 2 design brings the essential advantages of the invention.

Example 7

Multiwell Cartridge, 384 Individual Reaction Wells

Figure 7:
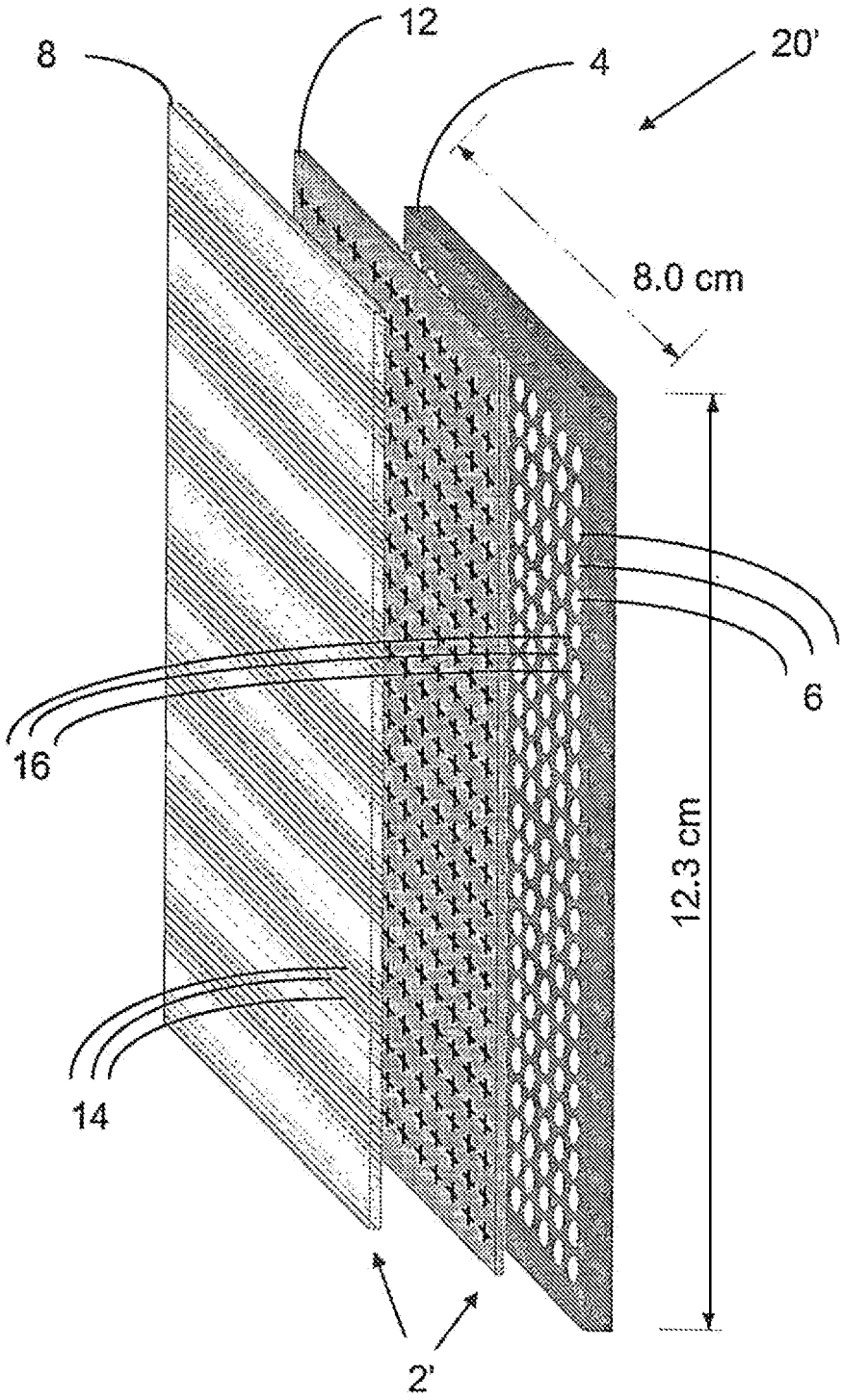
Figure 7 (PRIOR ART)
FIG. 7 schematically shows, with an exploded view of the cover, a 384-well bioassay cartridge system according to prior art.

FIG. 7 shows a prior art multiwell cartridge system 20' composing of 384 individual reaction chambers 6, made of a standard 384 well plate 4 sealed with a standard cover 2' material made of metal foil 8—plastic bilayer 12. The plastic layer 12 (on bottom) is pre-scored (+-shape) at the point of expected piercing. The top layer 8 is hermetic made of metal foil. The reaction chambers 6 are packed with dried reagents.

The cartridge system 20' is used for a bioassay. The sample is added into the reaction chamber 6 with a dispensing needle. When the needle is pierced through the bilayer cover 2', the edges of the pre-scored layer 12 are bending downwards; while at retraction of the needle the edges do not revert properly because the foil layer 8 is not elastic enough. Thus, sufficient sealing of the well 6 after sample addition is not achieved. In addition, close proximity of the pre-scored 12 and hermetic 8 layers wrap around the dispensing needle too tight in order to allow for substitute air to flow out reliably. Moreover, the design is vulnerable to carry over from well 6 to well 6' due to spillovers. This cover 2' design represents the state-of-the-art. The hollow layer is missing, thus this cover does not bring the advantages of the invention.

If the pre-scored plastic layer would be on top and the metal foil on the bottom an additional problem would be occasional dropping of pieces of metal foil into the reaction chambers at the sites of piercing.

The invention claimed is:

1. A system (20) comprising a bioassay cartridge (4), comprising at least one reaction chamber (6) containing bioaffinity reagents in a dried state, and a piercable hermetic cover (2) not allowing, before being pierced, any flow or diffusion of matter to or from said reaction chamber (6) through said cover (2), wherein a) said cover (2) comprises at least a top layer (8), a middle layer (10), a bottom layer (12), and a site intended for piercing (14);

b) said top layer (8) and bottom layer (12) are spaced apart by a constant distance from each other;

c) when said cartridge (4) is covered with said cover (2) said bottom layer (12) is against said cartridge (4), and said site (14) is at an opening (16) of reaction chamber (6);

d) said cover (2) has, at the site (14), a hollow space (18) between said top layer (8) and said bottom layer (12), and which extends through said middle layer (10); and e) either said top layer (8) or said bottom layer (12) is hermetic until piercing; and either said bottom layer (12) or top layer (8), respectively, is pre-scored, such that i) when being pierced by a needle, a pierce joint is created which is not gas tight but instead allows gas to freely flow out from the reaction chamber (6), and ii) said layer ensures a tight closing of a needle track upon retraction of said needle.

2. The system (20) of claim 1, wherein at each site (14) the volume of each hollow space (18) is from 5% of to 10 fold the volume of the corresponding reaction chamber (6).

3. The system (20) of claim 2, wherein the volume of each hollow space (18) is from 15% of to 3 fold the volume of the corresponding reaction chamber (6).

4. The system (20) of claim 3, wherein the volume of each hollow space (18) is from 50% of to 2 fold the volume of the corresponding reaction chamber (6).

5. The system (20) of claim 1, wherein a thickness of hollow space (18) is from 0.1 mm to 20 mm.

6. The system (20) of claim 5, wherein said thickness is from 0.3 mm to 10 mm.

7. The system (20) of claim 6, wherein said thickness is from 1 mm to 5 mm.

8. The system (20) of claim 1, wherein a width, measured essentially perpendicular to an intended axis of piercing, of the hollow space (18) at the site (14) is from 1.5 mm to 2 fold the width of an opening of the reaction chamber (6) covered with said cover (2).

9. The system (20) of claim 8, wherein said width is from 2 mm to 1.5 fold the width of the opening of reaction chamber (6).

10. The system (20) of claim 8, wherein said width is from 2.5 mm to 1 fold the width of the opening of reaction chamber (6).

11. The system (20) of claim 1, wherein said top or bottom layer is pre-scored in a shape selected from the group consisting of +-shaped, X-shaped, Y-shaped and I-shaped.

12. The system (20) of claim 1, wherein the cover (2) comprises at least one further layer (22) above, between, or below the top (8), middle (10) and/or bottom (12) layers.

13. The system (20) according to claim 12, wherein said further layer (22) is on top of said top layer and includes a hollow space (24) at said site (14).

14. The system (20) of claim 1, wherein a volume of the reaction chamber (6) is from 5 μl to 500 μl.

15. The system (20) of claim 14, wherein said volume is from 5 μl to 50 μl.

16. The system (20) of claim 15, wherein said volume is from 10 μl to 30 μl.

* * * * *